United States Patent [19]

Barny et al.

[11] 4,449,450

[45] May 22, 1984

[54] RETRACTABLE PROPULSION APPARATUS FOR CARDBOARD BOX PRINTING MACHINE

[75] Inventors: Jean-Jacques Barny, Villefranche; Bernard Capdeboscq, St. Just Chaleyssim, both of France

[73] Assignee: S.A. Martin, Villeurbanne, France

[21] Appl. No.: 402,677

[22] Filed: Jul. 28, 1982

[51] Int. Cl.[3] ..... B41F 5/06; B41F 21/00; B41F 13/34

[52] U.S. Cl. ..... 101/232; 101/183; 101/216

[58] Field of Search ..... 101/216, 212, 219, 232, 101/180, 181, 183, 184, DIG. 28

[56] References Cited

U.S. PATENT DOCUMENTS 2,435,791 2/1948 Luehrs ..... 101/180
2,692,554 10/1954 Bamford ..... 101/157

FOREIGN PATENT DOCUMENTS 2474952 8/1981 France .

*Primary Examiner*—Clifford D. Crowder
*Attorney, Agent, or Firm*—Pollock, Vande Sande & Priddy

[57] ABSTRACT

Cardboard box forming and printing machine on which it is possible to effect a change of block on the printers without loss of time detrimental to the output of the machine. The printing modules of the machine are equipped to enable lateral translation either of the block-holder cylinder alone, or of the unit constituted by the block-holder cylinder and its inking device, as well as retractable means for propelling the cardboard which can be positioned when the block-holder cylinder is retracted laterally so as to continue to ensure the operation of advancing the cardboard provided by the latter before its lateral retraction.

1 Claim, 6 Drawing Figures

RETRACTABLE PROPULSION APPARATUS FOR CARDBOARD BOX PRINTING MACHINE

FIELD OF THE INVENTION

The present invention relates to cardboard box forming and printing machines and relates more particularly to a machine of this type in which it is possible to effect a change of block on the printers without loss of time prejudicial to the output of the machine.

In a corrugated cardboard box production unit, the series of identical boxes are generally short, so that a considerable production loss is due to the time necessary for the different adjustments of change of format and printing between two different series of boxes.

BACKGROUND OF THE INVENTION

Certain constructors have the maximum number of automatic adjustments on the machines for folding and notching the cardboard, but it is nonetheless necessary to devote considerable time to placement of the blocks on the printers and to the washing of their inking cylinders. In the case of overhead printing flexographic printers, this drawback is offset by taking advantage, when possible, of the passage of a series of boxes which are to be printed with a reduced number of colors, for example one instead of two, to disengage the unused block-holder cylinders of the printing modules and to carry out the positioning of further blocks on the latter while the machine operates with said reduced color series.

Such a solution is unfortunately, through lack of space and possibility of access, not applicable to bottom-printing flexographic printers, the use of which appears to be more and more desirable with the development of entirely automatic machines.

One solution which could be envisaged to resolve this problem would be a modular construction with complete lateral displacement of the unused printing elements during the passage of the reduced color series. One or several gaps would then be created in the machine, which it would be necessary to fill by bringing together all the elements remaining in the machine so that they may be coupled. Such a solution would have the drawback of constantly modifying the length of the machine and, in addition, would occupy much space on the floor since it would be necessary to move each complete printing element laterally, including, in particular, its electrical panels, and hence constituting a rather bulky unit.

OBJECT OF THE INVENTION

It is an object of the invention to provide a machine which does not have the drawbacks of the aforementioned devices.

In a machine of this type, the printing modules are equipped with means enabling lateral translation either of the block-holder cylinder alone, or of the unit constituted by said block-holder cylinder and its inking device, and the machine is in addition provided with retractable means for propelling the cardboard, capable of being placed in position when said block-holder cylinder is withdrawn laterally so as to continue to assure the function of propelling the cardboard that the latter assured before its lateral withdrawal.

BRIEF DESCRIPTION OF THE DRAWINGS

The invention will be better understood on reading the following description of a preferred embodiment of a machine according to the invention, with reference to the accompanying drawings in which.

DESCRIPTION OF A PREFERRED EMBODIMENT

Figures 1, 2:
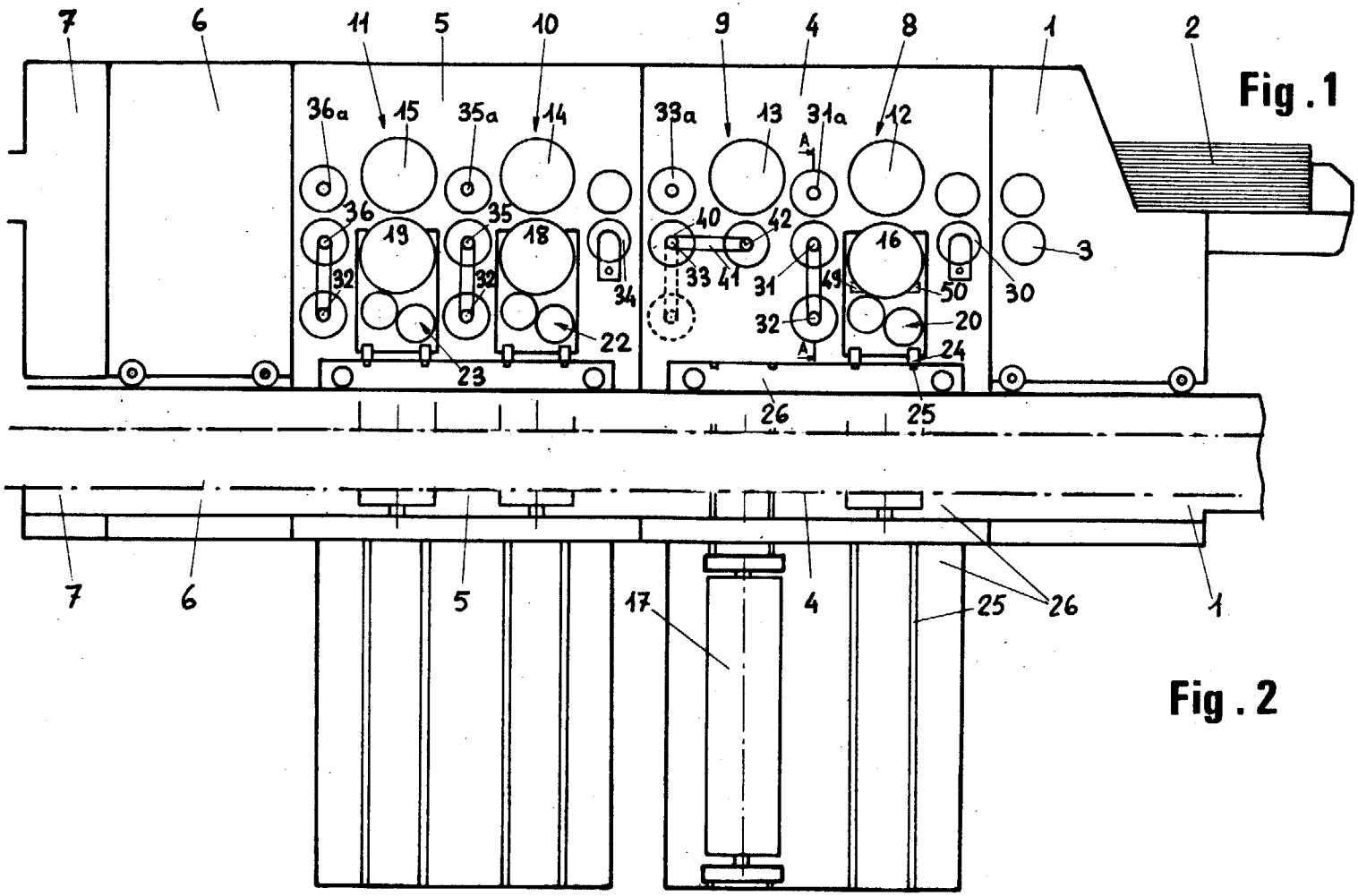
FIG. 1 shows diagrammatically and in side view, a forming and printing machine for cardboard boxes according to the invention.
FIG. 2 is a partial diagrammatic plan view of the printing machine of FIG. 1.

The diagrammatic lateral elevation view of FIG. 1 shows the first element of a production line machine for forming and printing corrugated cardboard boxes, comprising:

a feed unit 1 on which has been shown the stack 2 of cardboard sheets to be formed and one of the pairs of drive rolls 3.

a first printing element 4 which can be a two color unit.

a second printing element 5 which can also be a two color unit.

a notching element 6.

a folding element 7.

The elements 1, 6 and 7 are conventional units for this type of machine, so a more detailed description will not be given. On the other hand, particular attention will be given, by means of the group of FIGS. 1 to 5, to the description of the printing elements to which the invention particularly relates.

As is seen, particularly in FIGS. 1 to 4, each printing element 4, 5 includes two printer modules 8, 9 and 10, 11 each provided with a backing roller 12, 13, 14, 15, a block-holder cylinder 16, 17, 18, 19, and a conventional inking roll 20, 21, 22, 23.

Figure 3:
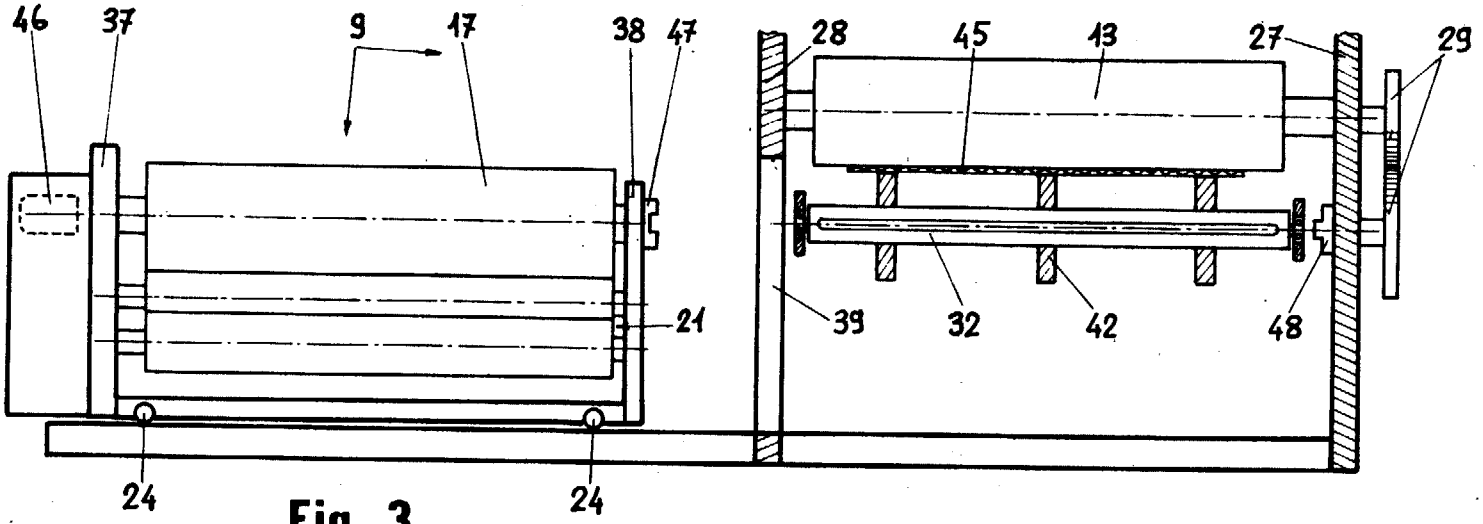
FIG. 3 is a transverse diagrammatic view of one of the printing modules with its block-holder cylinder unit retracted laterally, in "out" position.
Figure 4:
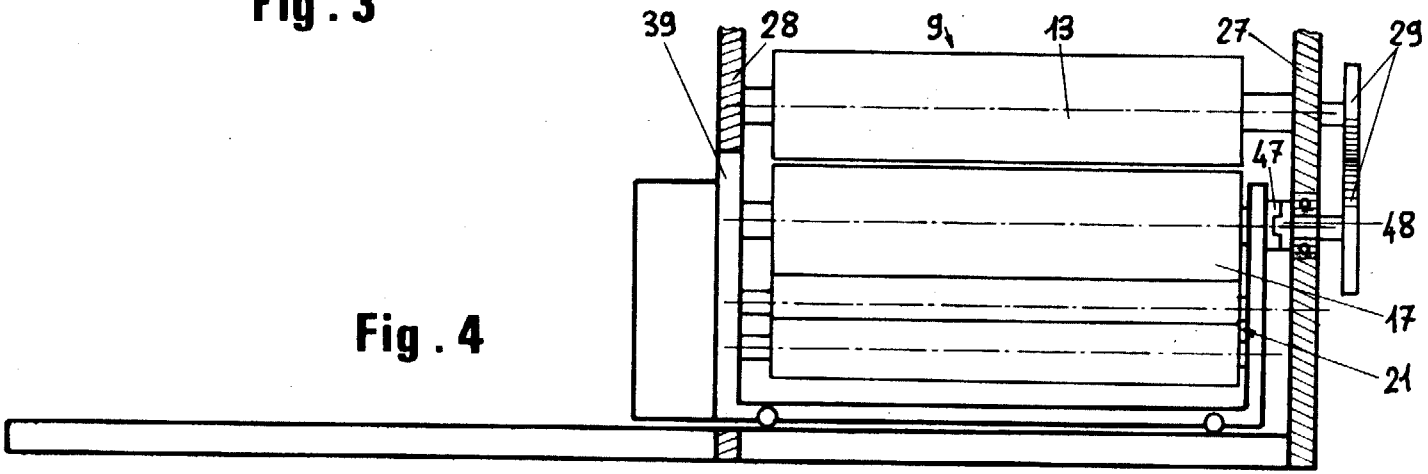
FIG. 4 is a transverse diagrammatic view of the module of FIG. 3, with its block-holder unit in "in" or working position.

In addition, each unit constituted by a block-holder roll and its inking system is moveable laterally, by means of rollers 24 and associated rails 25 hollowed in the base 26 of each printing element. FIGS. 1 to 3 show, by way of example, the second of these units taken in the upstream downstream direction, retractable by lateral translation, and a more precise description of the latter will therefore now be given, it being understood that this description applies equally to the three others.

The printing module 9 concerned includes a structure constituted by lateral frames 27 and 28. A conventional gear wheel unit 29, in a manner known per se, enables, the various rollers and drive shafts 3, 30, 31, 32, 33, 34, 35, 36, or printing rolls and drive shafts 16, 18, 19, to be given a movement in synchronism with the other elements of the cardboard processing line.

The retractable unit constituted by the block-holder cylinder 17 and its conventional inking system shown diagrammatically at 21 is mounted on a separate rigid structure, comprising uprights 37 and 38, and which can pass through an opening 39 the frame 28. The structure 37, 38 is provided with lateral displacement rollers 24 mentioned previously.

Figure 5:
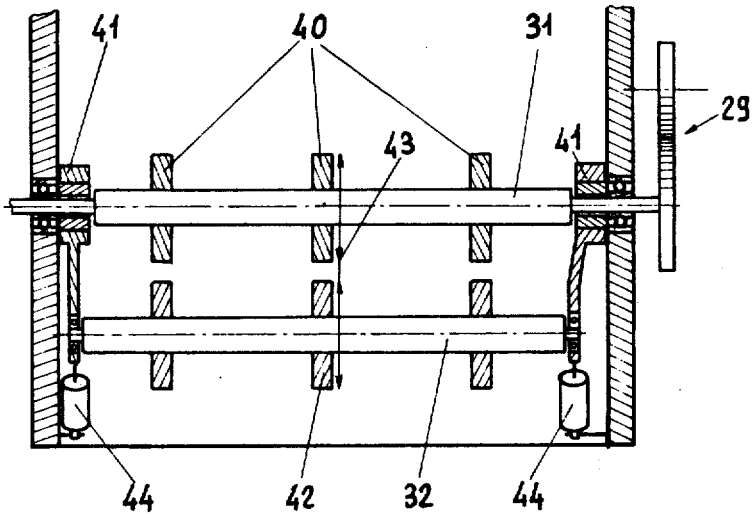
FIG. 5 is a partial and diagrammatic transverse view of a retractable propelling device for the cardboard, along the direction AA of FIG. 1.
Figure 6:
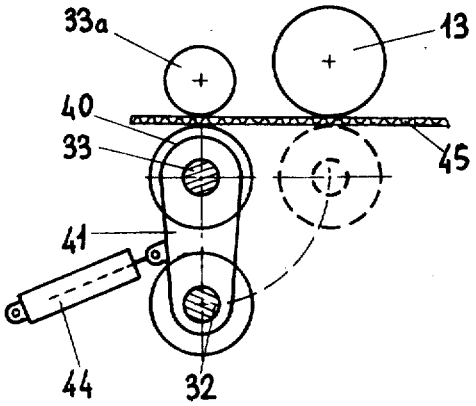
FIG. 6 is a detail of FIG. 1, showing, in lateral view, the operation of one of said retractable propelling devices for the cardboard.

In accordance with the invention, each printing element 4, 5 includes in addition, following directly, in the direction of passage upstream downstream of the cardboard, with each printing module 8, 9 and 10, 11, a pair of shafts 31-31*a*, 33-33*a* and 35-35*a*, 36-36*a* each provided with discs 40 for driving the cardboard (see also FIGS. 5 and 6). Each of the lower shafts 31, 33, 35, 36 includes at each end an oscillating lever 41 on which is mounted another drive shaft such as 32, provided with discs 42 identical with the discs 40, and rotated through the principal shaft such as 33 by means of a conventional belt transmission 43. As is seen clearly in FIGS. 1 and 6, the parallel shafts 33, 32 are separated by a length equal to the longitudinal component of the distance separating the axis respectively of the first shaft 33 or of it associated element 33*a* from the axis of the preceding printing roll 17 or of its counterpart 13.

In a way, when one of the block-holder rolls such as 17 is withdrawn laterally and hence no longer assures its auxiliary function of driving the cardboard, it suffices to pivot, by means of two pneumatic jacks 44, for example, the levers 41 and hence the shaft 32, by 90°, in order that the shaft 32 may be in a suitable position to assure the propulsion of the cardboard sheets 45 by gripping the latter with the backing roll 13.

The return of the removable unit 17, 21 is carried out in the following manner (see particularly FIGS. 3 and 4):

After having withdrawn the auxiliary shaft 32 downwards, by retraction of the rods of the jacks 44, the roll 17 and its female coupling element 47 are rotated by means of an auxiliary motor 46, and the unit is moved to the right by means of rollers 24. When the female element 48 drops in concordance with the male coupling element 47 driven through gear wheels 29 the angular position of which is preregulated according to the sheets to be printed, the device unlocks automatically and the machine is in good position for the series of sheets which will arrive, i.e., the block will be correctly positioned with respect to the first sheet, which avoids waste and reduces the adjustment times.

In the example which has just been described, each block-holder roll, such as 16, and its inking system such as 20, was made laterally removable, which is preferred when it is desired to wash the inking system. However, the block-holder roll alone could be translated laterally by simply sliding it on rails 49, 50 provided for this purpose.

We claim:

1. Cardboard forming and printing machine, comprising printing modules equipped with means enabling lateral translation of a block-holder cylinder assembly comprising at least a block-holder cylinder, said machine comprising in addition a retractable propulsion device for cardboard positionable when said block-holder cylinder is retracted laterally so as to continue to assure the propelling function of the cardboard that the latter assured before its lateral translation, said propulsion device being positioned at the end of at least one oscillating lever having its axis of rotation coaxial with that of the lower propulsion device which follows the printer module associated with said block-holder cylinder and at a distance from said axis equal to the longitudinal component of the distance separating said axis from the axis of the preceding printing roll.

* * * * *